US005436038A

United States Patent [19]

Gelb

[11] Patent Number: 5,436,038

[45] Date of Patent: Jul. 25, 1995

[54] TRANSPARENT ARTICLE AND METHOD FOR WHICH A CUT INTERNAL SURFACE IS REFLECTIVE FROM ONE VIEWING ANGLE AND TRANSLUCENT FROM ANOTHER

[76] Inventor: Michael Gelb, P.O. Box 87, Upton, Mass. 01568

[21] Appl. No.: 16,831

[22] Filed: Feb. 12, 1993

[51] Int. Cl.[6] ..... B44C 3/06

[52] U.S. Cl. ..... 428/13; 427/290; 428/67; 428/155; 428/542.2; 434/82

[58] Field of Search ..... 428/13, 542.2, 67, 155; 434/82; 427/290

[56] References Cited

U.S. PATENT DOCUMENTS

| | | | |
|---|---|---|---|
| 3,344,098 | 9/1967 | Horiguchi et al. | 524/460 |
| 3,940,523 | 2/1976 | Lecoeur et al. | 428/38 |
| 3,954,397 | 5/1976 | Desiderio et al. | 8/436 |
| 4,277,139 | 7/1981 | Cox | 428/13 X |
| 4,451,264 | 5/1984 | Ulry et al. | 8/508 |
| 4,830,899 | 5/1989 | Nakahashi et al. | 428/13 X |
| 5,082,703 | 1/1992 | Longobardi | 428/38 |

OTHER PUBLICATIONS

Information Bulletin *Weld-On 3 Acrylic Plastic Cement* by IPS Industrial Polychemical Service, Gardenia, California.

Information Bulletin *Weld-On 40 Acrylic Plastic Cement* by IPS Industrial Polychemical Service, Gardenia, California.

Schwartz Chemical Co. Inc., Material Safety Data Sheet, Nitro Dye Concentrate.

*Primary Examiner*—Henry F. Epstein

*Attorney, Agent, or Firm*—Darby & Darby

[57] ABSTRACT

A sculpture is provided having cuts extending from an exterior surface to an internal position. The cuts are then smoothed using a solvent and simultaneously dyed with an appropriate pigment. The resulting internal faces exhibit both reflectivity and translucency depending on the illumination and viewing angles.

13 Claims, 1 Drawing Sheet

FIG.1
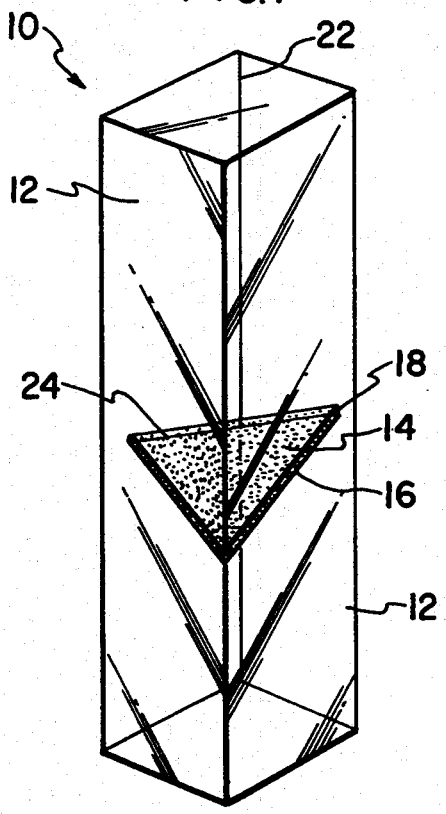
FIG.2
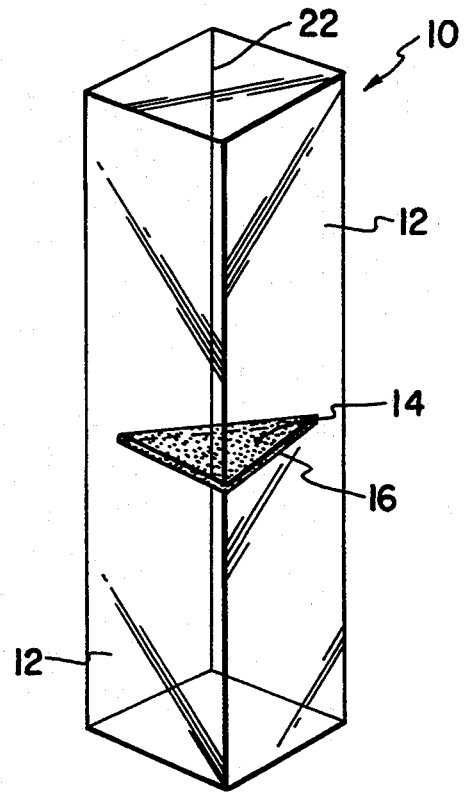
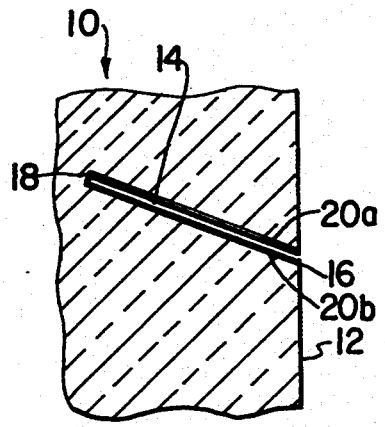
FIG.3
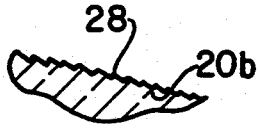
FIG.4A
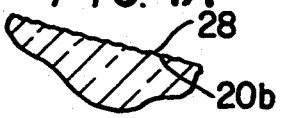
FIG.4B
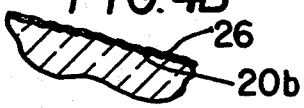
FIG 4C
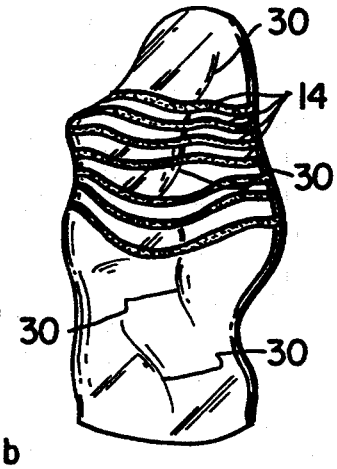
FIG.5

TRANSPARENT ARTICLE AND METHOD FOR WHICH A CUT INTERNAL SURFACE IS REFLECTIVE FROM ONE VIEWING ANGLE AND TRANSLUCENT FROM ANOTHER

FIELD OF THE INVENTION

This invention relates generally to sculpted articles of manufacture. More specifically, this invention relates to sculpture having internal surfaces which display a variety of properties.

BACKGROUND OF THE INVENTION

Sculpture, articles of manufacture, and articles found in nature that have internal structures or colorations have long intrigued both artist and observer. For example, the semi-precious opal has been desired for centuries due to its internal "fire". This fire, which consists of colorations on thin internal faces, has been difficult to match in any artificially created object. However, in other environments, both artistic and commercial, there have been many other designs that include coloration within an internal structure. This has become more prevalent in recent years with the advent of acrylics and other transparent plastic materials that can be relatively easily formed around or on top of colored or textured materials to give the appearance that such materials are actually an integral part of the article within.

Two examples of this type of article are shown in U.S. Pat. Nos. 3,940,523 and 5,082,703 to Lecour et al. and Longobardi, respectively. Longobardi discloses a sign that includes a transparent base onto which viscus ink is deposited to form a design. The ink is thick enough that textures can be formed on the ink to create various surface appearances. A sheet can then be applied over the viscus ink and onto the substrate to give the appearance that the inked design was etched or embossed, Lecour et al. disclose a decorative object that includes an acrylic glass plate onto which various differently colored layers of polymethyl methacrylate can be deposited. The layers can be limited to various portions of the support plate and built one on top of the other to give the appearance that the colors are integral with the support plate and not merely a layer deposited onto it.

It is also known that by etching alphanumerics into a flat transparent support plate, the alphanumerics can be illuminated by supplying light to the side edges of the plate. As the light travels through the plate, which now serves as a light guide, the internal surfaces created by the etched alphanumerics, which are usually frosted, scatter the light out of the plane of the plate and thus appear illuminated.

It is known that by adhering to flat surfaces of adjacent acrylic pieces, the pieces can be made to appear continuous. With an appropriate dye, one of those surfaces could be colored. Thus, when the two surfaces were brought together and bonded, the plane of coloration, assuming it had not been altered by the adhesive, would appear to be suspended within the continuous block as though the acrylic block had been formed originally with a plane of color within it. However, this process becomes difficult and tedious as the number of desired planes of color increases. Further, the plane of color would not reflect or refract any light passing through it, but would merely tint the area, that is, it would appear that dye was added to the continuous clear solution.

SUMMARY OF THE INVENTION

It is thus an object of the invention to create an article with internal surfaces capable of reflection and refraction.

It is another object of the invention to provide an article that has colored internal surfaces.

It is yet another object of the invention to provide an article that provides internal parallel surfaces.

In accordance with the objects of the invention, an article is provided having cuts extending from an exterior surface to an internal position. The cuts are then smoothed using a solvent and simultaneously dyed with an appropriate pigment. The resulting internal faces exhibit both reflectivity and translucency depending on the illumination and viewing angles.

BRIEF DESCRIPTION OF THE DRAWINGS

These and other objects, advantages and embodiments will become apparent to those skilled in the art upon reading the following detailed description in conjunction with a review of the appended drawings, in which:

FIG. 1 is a perspective view of an article having a cut formed therein;

FIG. 2 is a perspective view of the article in FIG. 1 from a different viewing angle;

FIG. 3 is a cross-sectional view of a cut in an article according to the invention;

FIGS. 4A–4C are cross-sectional side views of an internal surface during manufacture of an article according to the present invention;

FIG. 5 is a perspective view of another embodiment of the invention; and

DETAILED DESCRIPTION OF THE PREFERRED EMBODIMENTS

Referring now to FIG. 1, a sculpture 10 according to the present invention is shown. In a preferred embodiment, the overall shape is a rectangular prism with planar outer surfaces 12. However, as will be discussed further below, other exterior surfaces are contemplated as well. Formed in the sculpture 10 is a cut 14 which is open to the outer surface 12 of the sculpture 10 at its mouth 16. The cut 14 extends into the sculpture 10 to a rear point 18 within the interior of the sculpture 10, but preferably does not penetrate completely through the sculpture 10. If the cut 14 extended completely through, the sculpture 10 would be severed and some of the advantages of the invention may be lost.

The cut 14 may be formed through any known methods, preferably using a saw (not shown), depending on the width of the cut 14 that is desired. Other types of cutting methods such as water jets, lasers and other mechanical cutting devices are contemplated as well. In the preferred embodiment the cut 14 is a straight cut into the sculpture 10, i.e., the two internal surfaces **20*a*,20*b* formed by the cut 14 are planar and parallel to each other. It is also contemplated that the cut 14 might be curved or might be widened by applying several passes of the blade into the sculpture 10, which would widen the cut 14 and displace the two inner surfaces 20*a*,20*b*** from each other.

In the preferred embodiment, the internal surfaces **20*a*,20*b*** become mirrored or reflective at particular viewing angles and illumination angles, depending on the material used. This effect is seen in FIG. 2, in which the material behind the internal surfaces 20a,20b along the line of sight of the figure cannot be seen. The same surfaces, when viewed at a different angle or illuminated from a different angle will become translucent or transparent, as seen in FIG. 1. At this angle, the rear outer edge 22 of the sculpture 10 and the interior corner 24 of the cut 14 can be seen through the upper internal surface 20a. The reflective/translucent nature of the surfaces 20a,20b and its causes will be more fully described below.

As can be seen in FIGS. 1 and 2, the preferred embodiment includes pigmentation 26 on the internal surfaces 20a,20b. The pigment 26 causes both the translucent and reflective transmission of light, depending on the angle, to be tinted.

To create the surface features of the internal surfaces 20a,20b, the cut 14 is formed as discussed above, preferably with a saw. The internal cut surfaces 20a,20b of the preferred material, clear acrylic, then have a white frosted surface that is practically opaque. To prepare the surfaces for further treatment, the internal surfaces 20a,20b of the cut 14 may be smoothed out with sand paper or other buffing materials. Preferably, standard silicon carbide sand paper is used to remove the residue from the cutting, such as grease from the blade or melted acrylic left behind from the cutting action.

It is preferred that the surface striations 28 on the internal surface caused by the saw blade (see FIG. 4A) remain. Thus, the sanding or buffing step should only reduce the striations 28, such as shown in FIG. 4B, but not eliminate them. If the striations are removed and the internal surfaces 20a,20b are polished smooth, the internal surfaces lose most of their reflective property and only become reflective at extremely shallow viewing angles.

The preferred method of achieving the pigmentation on the internal surfaces 20a,20b of the sculpture 10 is with a combined solution of solvent and pigment. The solvent partially dissolves the internal surfaces 20a,20b so they are generally clearer than they would be after only cutting and/or sanding. The solvent also primes the internal surface for the pigment 26, which pigments a thin layer of the sculpture 10 at the internal surface 20b and remains after the solvent is removed from the cut 14 (see FIG. 4C). Similar results occur with the upper internal surface 20a. To assist pigmentation of the internal surfaces 20a,20b, the surfaces are preferably rough when the solvent/pigment mixture is injected. If the striations 28 formed during cutting are removed, a rough (i.e., not polished) surface should remain to allow the pigment 26 to adhere properly.

In practice, different cuts may be dyed with different colors for various aesthetic effects. This is accomplished by sealing off the mouths 16 of the cuts 14 with tape (not shown) or other covering, except for the particular cut or cuts to be dyed. The solvent/pigment solution is injected into the one open cut and then blotted out, leaving behind a thin layer of pigmented material 26 on the internal surfaces (see FIG. 4C). The preferred solution must be quickly blotted from the cut to avoid congealing or hardening of the solvent within the cut. Filling in the cuts with a solvent or other filler, such as a molded piece, tends to eliminate the reflective properties.

Once the cuts 14 are completed, various other effects may be achieved by shaping the outer surfaces 12 of the sculpture 10 or adhering the sculpture 10 to an adjacent sculpture 10 having similar cuts 14. If the outer surfaces 12 are shaped, using grinders and the like, the resulting visual effect is that parallel internal cuts 14 have a curved appearance, due to the lensing effect of the various exterior curved surfaces 30 (see FIGS. 5 and 7). If two adjacent sculptures 10 having mating surfaces are bonded together with an acrylic type adhesive, much of the mouth 16 of many cuts 14 will be concealed at the interface between the two sculptures 10. It is preferred that the adhesive be applied in a quantity and manner such that minimal amounts of the adhesive will be pressed into the cuts 14 of the sculpture 10. For example, the cuts of the adjacent sculptures may be masked with clear tape and then mated, although some tape is then left behind between the sculptures. Alternatively, glue may be applied to the mating surface by a thin flat spacer (not shown). The mouths of the cuts on the mating surface are placed with the mouths facing down on the spacer to prevent glue from entering the cuts by gravity. Again, the spacer would remain between the adjacent sculptures.

In the preferred embodiment, the internal surfaces 20a,20b are parallel. The resulting effect approaches that of a single colored face within the sculpture, but with the added feature of reflection and translucency at different angles. Other non-parallel type cuts may be formed, although the effect is decreased as the angle between the internal surfaces increases, until eventually the two surfaces become viewed as two unrelated surfaces. The cuts 14 are preferably no wider than 1/16 inch, although wider cuts are possible.

The preferred solvent is WELD-ON #3, available from IPS Corporation of Garden, California. The preferred dye is Nitro-Dye Concentrate, available from Schwartz Chemical Company of Long Island City, N.Y. Other solvents and dyes may be used similarly. The ratio of solvent to pigment may be varied to achieve different levels of pigmentation of the internal surfaces, although if not enough solvent is used, the internal surfaces 20a,20b and the striations 28 will not become clear, but will retain their frosty appearance from the cutting and sanding.

Thus, it can be seen that the present invention provides a sculpture having internal surfaces that have both reflective and translucent properties and may be colored. Further, these surfaces may be formed without complex laminations or other layering techniques.

It is to be understood that the term sculpture is not limited to art objects, but may also refer to other types of articles or structures, which include, but are not limited to, architectural elements such as columns, walls or windows; furniture; lamps and other light sources; jewelry; and various containers.

While the embodiments shown and described are fully capable of achieving the objects and advantages of the invention, it is to be understood that these embodiments are shown and described solely for the purpose of illustration and not for the purpose of limitation.

What is claimed is:

1. A substantially transparent three dimensional article of manufacture; comprising:

a substantially transparent three-dimensional structure having an outer surface and at least one cut in said structure, said cut extending from said outer surface to an interior position, said cut having two internal surfaces within said structure that are substantially planar and parallel to each other, said cut having a depth greater than the distance between said two internal surfaces, at least one of said two internal surfaces being reflective when viewed at a first viewing angle and being translucent when viewed at a second viewing angle, said first and second viewing angles differing from each other.

2. An article of manufacture as in claim 1, wherein said internal surfaces are pigmented.

3. An article of manufacture as in claim 2, wherein said internal surfaces are striated.

4. An article of manufacture as in claim 1, wherein said cut forming said internal surfaces causes said internal surfaces to become practically opaque and appear frosted white.

5. An article of manufacture as in claim 1, wherein said structure is acrylic.

6. A substantially transparent three dimensional article of manufacture, comprising a substantially transparent three-dimensional structure having an outer surface and multiple cuts in said structure, said multiple cuts extending in parallel and forming internal surfaces within said structure, at least one of said internal surfaces being reflective when viewed at a first predetermined viewing angle and being translucent when viewed at a second predetermined viewing angle, said first and second viewing angles differing from each other; said outer surface being curved such that said cuts appear divergent.

7. An article of manufacture as in claim 6, wherein said multiple cuts forming said internal surfaces cause said internal surfaces to become practically opaque and appear frosted white.

8. An article of manufacture as in claim 6, wherein said structure is acrylic.

9. A method of making a three dimensional article of manufacture, comprising the steps of:

providing a three dimensional structure composed of a substantially transparent material;

forming a cut into a portion of said structure to produce two substantially planar and parallel internal surfaces within said structure that are practically opaque,; said cut being formed with a depth greater than the distance between said two internal surfaces; and introducing a solvent pigment solution into said cut such that at least one of said internal surfaces partially dissolves by the introduced solvent of the solution to become clearer than when after the step of forming a cut when the at least one internal surface was practically opaque and such that the at least one of said internal surfaces is simultaneously pigmented by the introduced pigment of the solution, whereby the three dimensional article of manufacture is realized.

10. A method as in claim 9 further comprising the step of:

repeating said step of forming to produce multiple cuts in said structure.

11. A method as in claim 10 wherein said multiple cuts are substantially parallel and further comprising the step of:

shaping an outer surface of said structure such that said multiple cuts will appear divergent.

12. A method as in claim 9, wherein the step of cutting causes the internal surfaces to appear frosted white.

13. A method as in claim 9, wherein said structure is acrylic.

* * * * *